US008347667B2

(12) United States Patent
Bacon

(10) Patent No.: US 8,347,667 B2
(45) Date of Patent: Jan. 8, 2013

(54) LOCKING PADDLE HANDLE LATCH ASSEMBLY FOR CLOSURES AND THE LIKE

(75) Inventor: Bruce C. Bacon, Rockford, MI (US)

(73) Assignee: Bauer Products, Inc., Grand Rapids, MI (US)

( * ) Notice: Subject to any disclaimer, the term of this patent is extended or adjusted under 35 U.S.C. 154(b) by 318 days.

(21) Appl. No.: 12/639,516

(22) Filed: Dec. 16, 2009

(65) Prior Publication Data

US 2010/0154489 A1 Jun. 24, 2010

Related U.S. Application Data

(60) Provisional application No. 61/203,403, filed on Dec. 22, 2008.

(51) Int. Cl.
*E05B 59/00* (2006.01)
*E05B 63/14* (2006.01)

(52) U.S. Cl. ..... 70/107; 70/208; 70/210; 70/278.7; 70/279.1; 292/216; 292/DIG. 31

(58) Field of Classification Search ..... 70/107–111, 70/208, 210, 278.7, 279.1; 292/DIG. 31, 292/194, 200, 216
See application file for complete search history.

(56) References Cited

U.S. PATENT DOCUMENTS 1,596,992 A * 8/1926 Ognowicz ..... 70/109
2,303,624 A * 12/1942 Edwards et al. ..... 70/110
4,237,709 A * 12/1980 Krugener et al. ..... 70/107
4,276,760 A * 7/1981 Nolin ..... 70/107
4,418,552 A * 12/1983 Nolin ..... 70/107
4,773,683 A * 9/1988 Nakamura ..... 292/216
4,986,576 A * 1/1991 Anderson ..... 292/40
5,027,625 A * 7/1991 Krachten ..... 70/107
5,127,686 A 7/1992 Gleason et al.
5,265,920 A * 11/1993 Kaup et al. ..... 292/40
5,875,948 A * 3/1999 Sadler ..... 224/404
5,884,948 A * 3/1999 Weinerman et al. ..... 292/216
5,927,773 A * 7/1999 Larsen et al. ..... 292/337
6,101,853 A * 8/2000 Herr ..... 70/109
6,409,234 B1 6/2002 Larsen et al.
6,513,353 B1 * 2/2003 Weinerman et al. ..... 70/208
6,604,393 B2 * 8/2003 Larsen et al. ..... 70/208
6,629,441 B2 * 10/2003 Lavergne ..... 70/278.3
6,651,467 B1 11/2003 Weinerman et al.
D485,155 S 1/2004 Bacon
6,685,240 B2 2/2004 Bacon
6,708,537 B1 3/2004 Eschweiler et al.
6,758,503 B2 7/2004 Sadler
6,854,304 B2 2/2005 Linares
6,857,298 B2 2/2005 Linares
(Continued)

*Primary Examiner* — Lloyd Gall
(74) *Attorney, Agent, or Firm* — Price Heneveld LLP

(57) ABSTRACT

A locking paddle handle assembly for closures has a housing with a paddle handle pivotally mounted therein, a latch which latches and unlatches the closure upon rotation of the paddle handle, and a exterior key lock with a movable member that shifts between locked and unlocked positions. A latch lock selectively engages the latch, such that when the movable key lock member is in the locked position, the latch is retained in the latched position, wherein the closure cannot be opened. A deadbolt lock selectively engages the closure frame in the locked position to positively retain the closure closed. Both the latch lock and the deadbolt lock are operably connected with the movable key lock member, such that movement of the latter between the latched and unlatched positions contemporaneously shifts both the latch lock and the deadbolt lock between the locked and unlocked positions.

15 Claims, 8 Drawing Sheets

U.S. PATENT DOCUMENTS 6,962,375 B2 11/2005 Linares
7,155,946 B2 * 1/2007 Lee et al. ..... 70/107
7,237,812 B2 7/2007 Tweedy
7,819,444 B2 * 10/2010 Kagawa et al. ..... 292/336.3
8,186,191 B2 * 5/2012 Bacon ..... 70/208
2003/0010073 A1 * 1/2003 Larsen et al. ..... 70/208
2003/0226384 A1 * 12/2003 Shedd et al. ..... 70/107

* cited by examiner

LOCKING PADDLE HANDLE LATCH ASSEMBLY FOR CLOSURES AND THE LIKE

CLAIM OF PRIORITY

Applicant hereby claims the priority benefits under the provisions of 35 U.S.C. §119e, basing said claim of priority on related provisional U.S. Patent Application Ser. No. 61/203,403, filed Dec. 22, 2008.

BACKGROUND OF THE INVENTION

The present invention relates to latches for movable closures and the like, and in particular to a locking paddle handle latch assembly.

Paddle handles are generally well known in the art, and are typically flush mounted on an associated closure or door to facilitate selectively shifting the closure between an open unlocked position and a closed locked position. Paddle handle assemblies are used widely on entry doors for recreational vehicles, motor homes and the like, and in such applications, require that the latch mechanism be accessible and operable from both the inside and the outside of the vehicle, and that they include a deadbolt lock for maximum security.

Heretofore, paddle handle assemblies have proven generally effective, although they experience certain drawbacks. For example, most prior art paddle handle assemblies require that the latch lock and the deadbolt lock be actuated separately, which increases the difficulty associated with operating the vehicle entry door. Also, such prior art paddle handle assemblies are not particularly adapted for use with remotely operated power actuators, which have become quite popular in the vehicle industry. Furthermore, some prior art paddle handle assemblies experience a problem in maintaining the alignment between the latch mechanism and the associated strike, and have a trigger configuration which can cause inadvertent unlatching and opening of the vehicle entry door. When a conventional prior art paddle handle mechanism is mounted on an associated vehicle entry door, the interior handle portion tends to interfere with the free sliding motion of the adjacent pleated or retractable screen door. Also, many prior art paddle handle assemblies have a rather complicated construction, which is expensive to manufacture, and difficult to repair. Hence, a paddle handle assembly which overcomes these drawbacks would clearly be advantageous.

SUMMARY OF THE INVENTION

One aspect of the present invention is a locking paddle handle latch assembly for closures and the like having a housing adapted for mounting adjacent an associated closure of the type that can be shifted between an open position and a closed position. A paddle handle is pivotally mounted in an exterior portion of the housing for rotation between a retracted position and an extended position. A latch is operably connected with the paddle handle, and configured such that when the paddle handle is in the retracted position, the latch is in the latched position, wherein the closure cannot be unintentionally shifted from the closed position, and when the paddle handle is in the extended position, the latch is in an unlatched position, wherein the closure is free to be shifted from the closed position to the open position. A key lock is mounted on the exterior portion of the housing, and includes a movable key lock member that is selectively movable between a locked position and an unlocked position. A latch lock is movably mounted in the housing, operably connected with the movable key lock member, and configured such that when the movable key lock member is in the locked position, the latch lock assumes a locked position in which the latch is retained in the latched position, and when the movable key lock member is in the unlocked position, the latch lock assumes a unlocked position in which the latch is free to be shifted between the latched and unlatched positions. A deadbolt lock is movably mounted in the housing for shifting between a locked position, wherein the closure is positively retained in the closed position, and an unlocked position, wherein the closure is free to be shifted between the open position and closed position. The deadbolt lock is operably connected with the movable key lock member, whereby movement of the movable key lock member between the locked and unlocked positions contemporaneously shifts both the deadbolt lock and the latch lock between the locked and unlocked positions.

Another aspect of the present invention is a paddle handle assembly, which has a ramp-shaped interior handle with a low profile, and an inwardly angled exterior portion, which deflects or leads a pleated screen or the like over the handle, so as to avoid interference therebetween. Preferably, a recess is formed in the rear mounting plate of the paddle handle assembly to facilitate grasping and rotating the interior release handle.

Yet another aspect of the present invention is a paddle handle assembly wherein a rotary latch is integrated in and moves with the paddle handle assembly, thereby minimizing alignment problems with the associated strike bolt. Preferably, a space is formed between the latch trigger and the rotary latch, which prevents inadvertent unlatching of the paddle handle assembly.

Yet another aspect of the present invention is a paddle handle assembly that has an uncomplicated design which is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
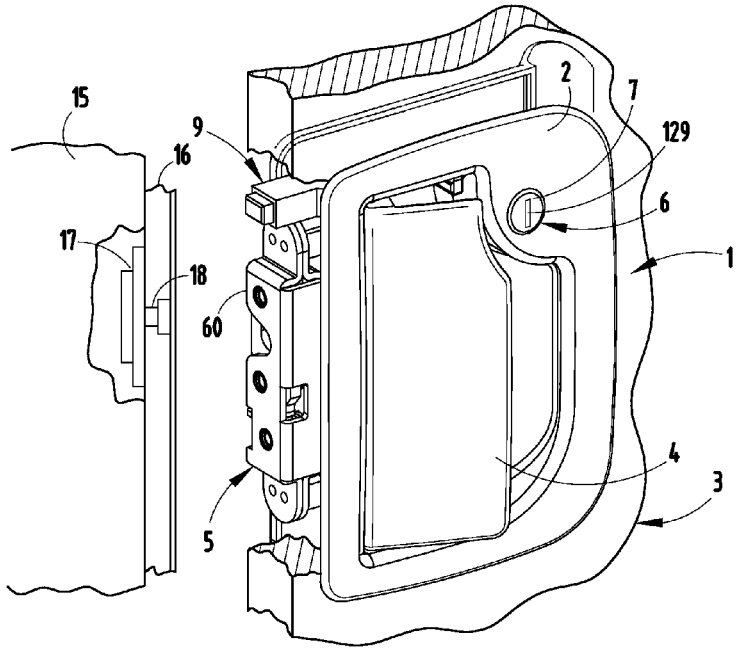
FIG. 1 is a perspective view of a lockable paddle handle latch assembly embodying the present invention, shown mounted in an associated closure.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
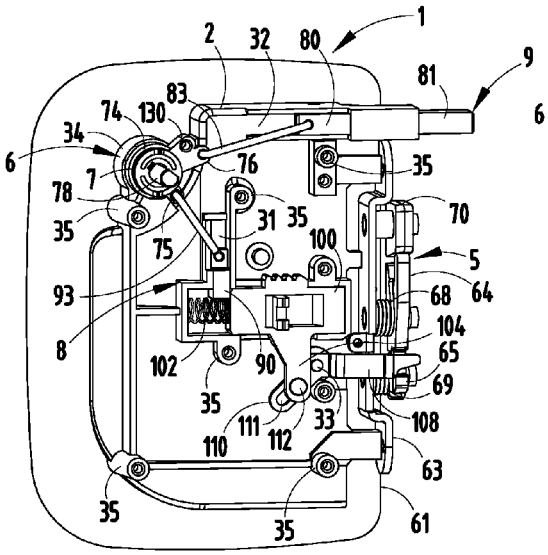
FIG. 2 is a perspective view of an interior portion of the locking paddle handle latch assembly, shown with a latch portion in a latched position, and latch lock and deadbolt lock portions thereof in a locked position.
Figure 3:
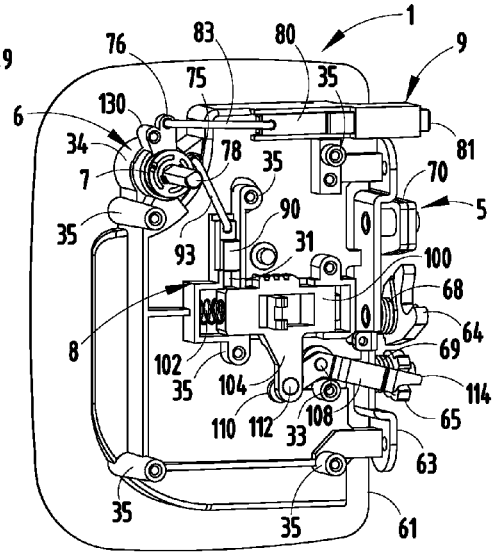
FIG. 3 is a perspective view of the interior portion of the locking paddle handle latch assembly, shown with the latch in an unlatched position, and the latch lock and deadbolt lock in an unlocked position.
Figure 6:
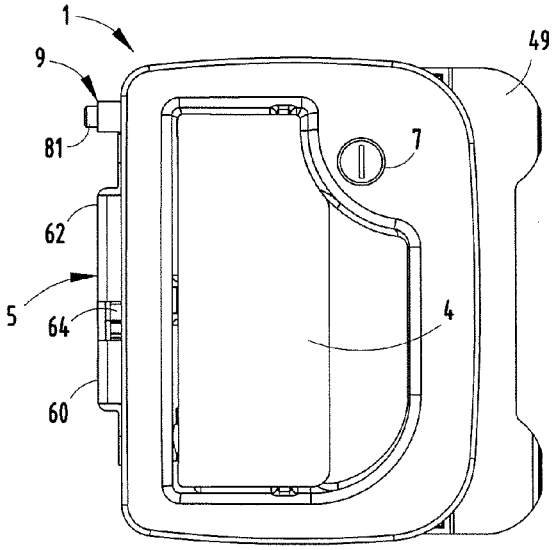
FIG. 6 is a front elevational view of the locking paddle handle latch assembly.
Figure 7:
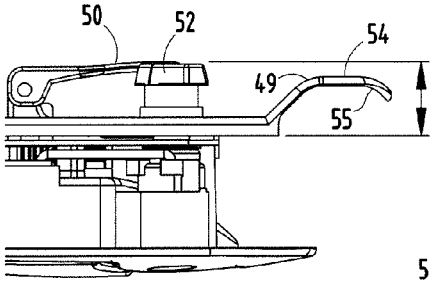
FIG. 7 is a fragmentary top plan view of the locking paddle handle latch assembly.

The reference numeral 1 (FIGS. 1-3) generally designates a locking paddle handle latch assembly embodying the present invention. Locking paddle handle latch assembly 1 includes a housing 2 adapted for mounting in or adjacent to an associated closure 3 of the type that can be shifted between an open position (FIG. 1) and a closed position. A paddle handle 4 is pivotally mounted in an exterior portion of housing 2 for rotation between a retracted position (FIG. 6) and an extended position (FIG. 1). A latch 5 is operably connected with paddle handle 4, and configured such that when paddle handle 4 is in the retracted position, latch 5 is in a latched position (FIG. 2), wherein closure 3 cannot be unintentionally shifted from the closed position, and when paddle handle 4 is in the extended position, latch 5 is in an unlatched position (FIG. 3), wherein closure 3 is free to be shifted from the closed position to the open position. A key lock 6 is mounted on the exterior portion of housing 2, and includes a movable key lock member 7 that is selectively movable between a locked position (FIG. 2) and an unlocked position (FIG. 3). A latch lock 8 is movably mounted in housing 2, operable connected with movable key lock member 7 and configured such that when movable key lock member 7 is in the locked position, latch lock 8 assumes a locked position (FIG. 2) in which latch 5 is retained in the latched position (FIG. 2), and when movable key lock member 7 is in the unlocked position, latch lock 8 assumes an unlocked position (FIG. 3) in which latch 5 is free to be shifted between the latched and unlatched positions. A deadbolt lock 9 is mounted in housing 2 for shifting between a locked position (FIG. 2), wherein closure 3 is positively retained in the closed position, and an unlocked position (FIG. 3), wherein closure 3 is free to be shifted between the open and closed positions. Deadbolt lock 9 is operably connected with movable key lock member 7, such that movement of movable key lock member 7 between the locked and unlocked positions contemporaneously shifts both deadbolt lock 9 and latch lock 8 between the locked and unlocked positions.

In the example illustrated in FIG. 1, the closure 3 in which locking paddle handle latch assembly 1 is mounted comprises an entry door for a recreational vehicle, motor home or the like, which can be pivotally shifted between open and closed positions along a substantially vertical hinge axis. Closure 3 selectively engages an associated doorframe 15 having a jamb section 16 in which a strike bolt assembly 17 is mounted. Strike bolt assembly 17 includes a laterally extending strike bolt 18 which selectively engages and disengages an associated portion of latch 5 to selectively retain closure 3 in the fully closed position, as described in greater detail hereinafter.

Figure 4:
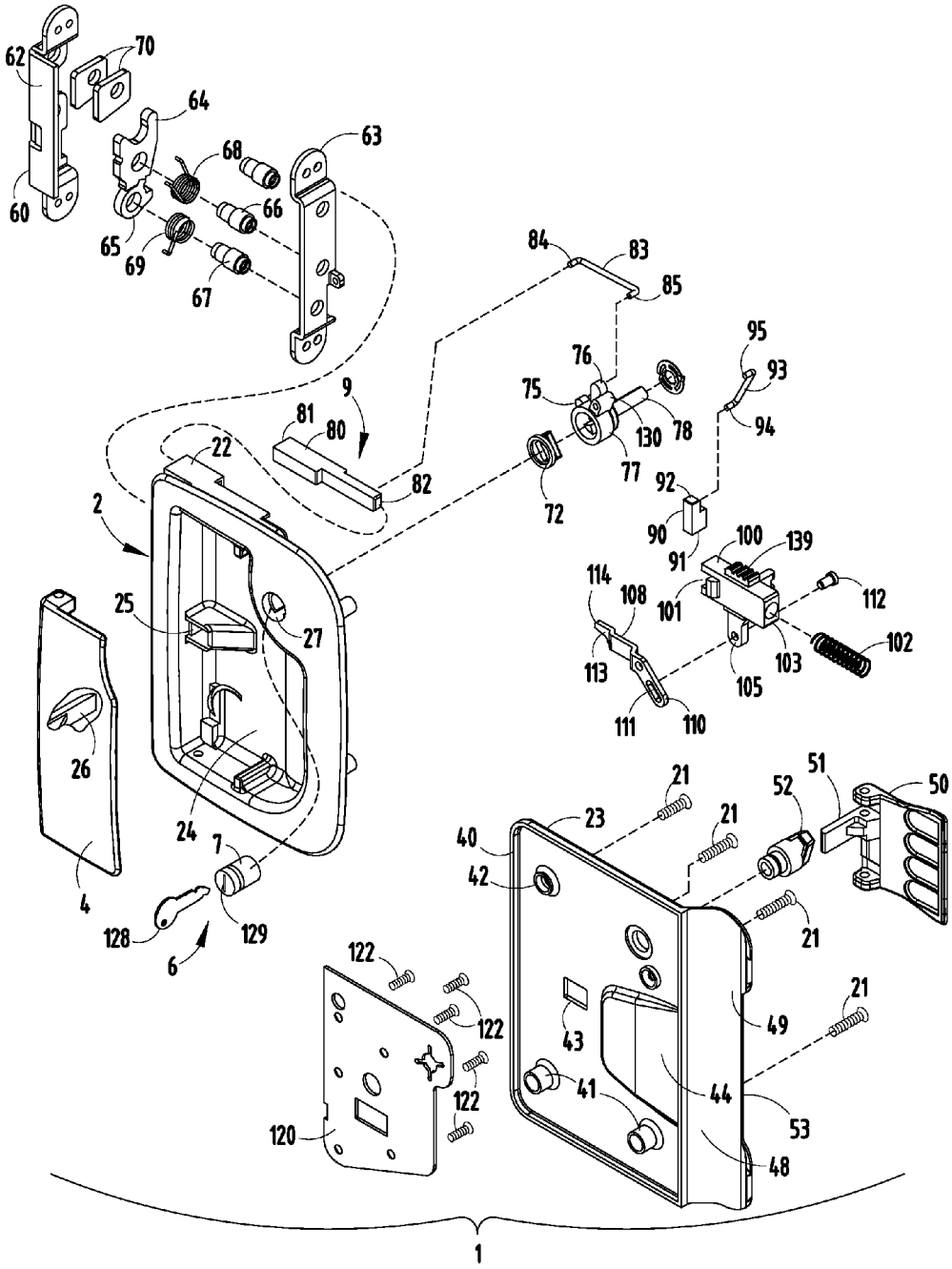
FIG. 4 is an exploded, perspective view of the locking paddle handle latch assembly.
Figure 4A:
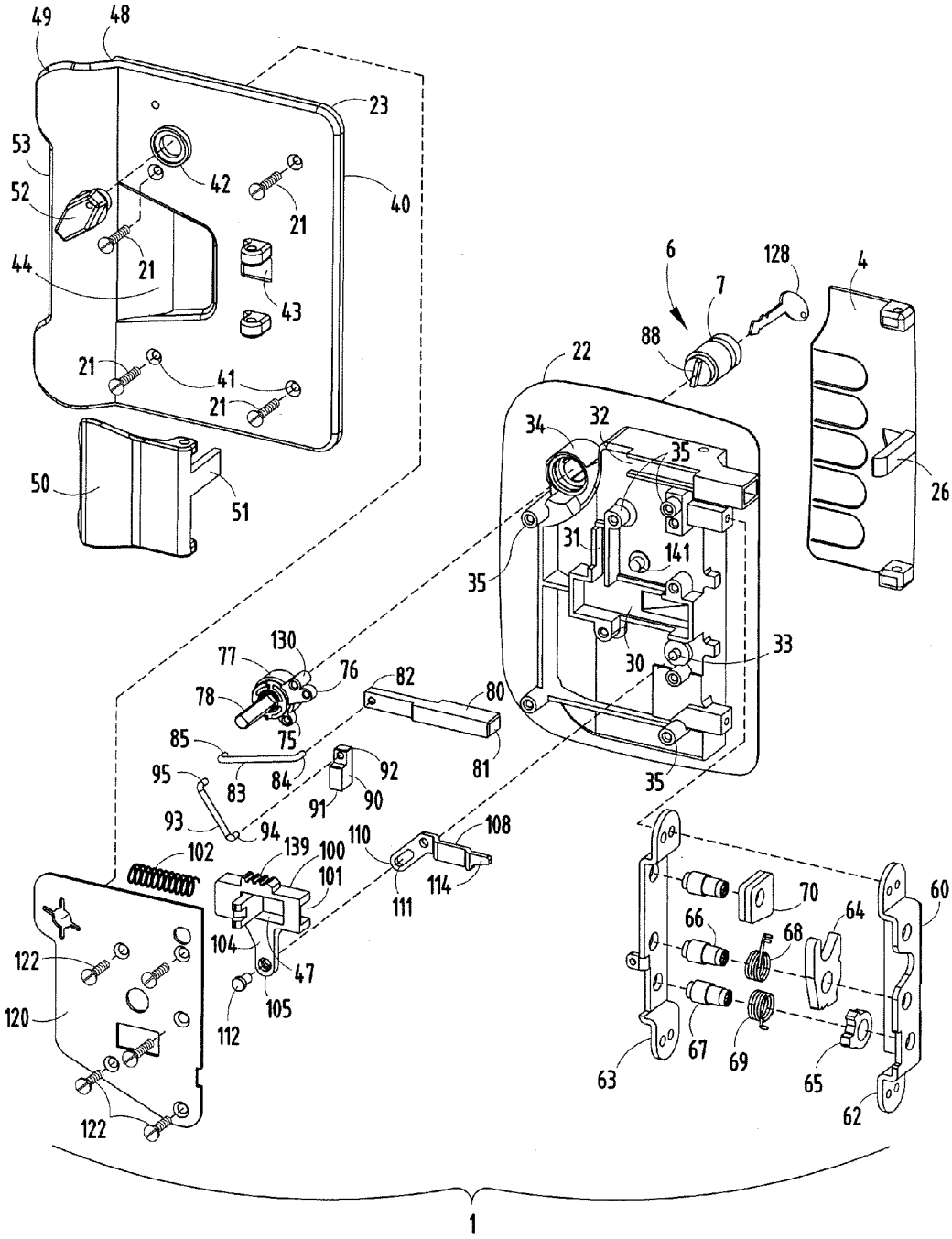
FIG. 4A is an exploded, perspective view of the locking paddle handle assembly, taken from an interior side thereof.
Figure 5:
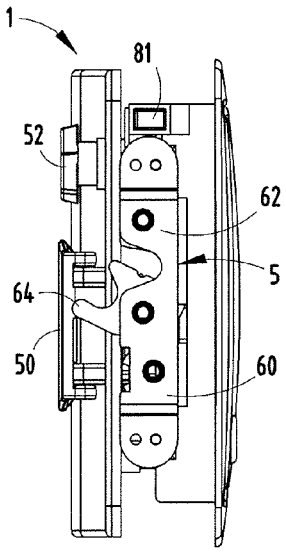
FIG. 5 is a side elevational view of the locking paddle handle latch assembly with the latch shown in the unlatched position.

As best illustrated in FIGS. 4 and 4A, the illustrated housing 2 has a two part construction, comprising an exterior plate 22 in which paddle handle 4 is pivotally mounted, and an interior plate 23 which mounts on the interior of closure 3 and is attached to exterior plate 22 by fasteners 21. The illustrated exterior plate 22 includes a centrally disposed, bowl-shaped recess 24 located directly behind paddle handle 4 which provides finger access to facilitate rotation of paddle handle 4 between the retracted and extended positions. The bottom wall of recess 24 includes an actuator window 25 through which an actuator tab 26 on paddle handle 4 extends to operate latch 5, as described in greater detail hereinafter. The marginal portion of exterior plate 22 includes a lock aperture 27 in which key lock 6 is mounted.

As best illustrated in FIGS. 2-4A, the inside surface of exterior plate 22 includes a centrally disposed, horizontally extending latch slide channel 30, a vertically extending latch lock slide channel 31, and a horizontally extending deadbolt lock slide channel 32 disposed vertically above latch slide channel 30 for mounting therein associated portions of locking paddle handle latch assembly 1, as described in greater detail hereinafter. The inside surface of the exterior plate 22 also includes an inwardly projecting pivot pin 33, a cylindrically-shaped lock boss 34, the interior of which defines lock aperture 27, and a plurality of rearwardly projecting fastener bosses 35 which facilitate connection of interior plate 23 to exterior plate 22 using fasteners 21.

Figure 8:
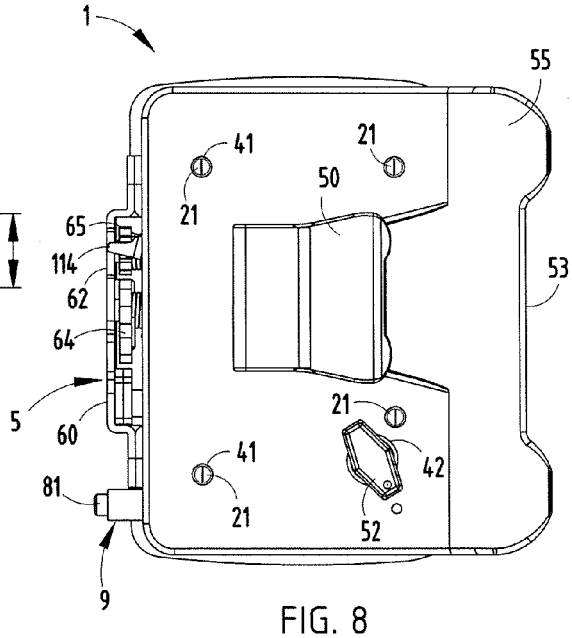
FIG. 8 is a rear elevational view of the locking paddle handle latch assembly.

The interior plate 23 (FIGS. 4-4A and 8) of housing 2 includes a marginal portion 40 which engages the interior surface of closure 3, as well as fastener bosses 41, a lock boss 42, a centrally disposed actuator window 43 and a trapezoidally-shaped finger recess 44. The rearwardmost or interior side edge 48 of interior plate 23 is contoured inwardly to define a stationary interior handle 49 which facilitates opening and closing closure 3 from the interior portion of the vehicle. A release lever 50 is pivotally mounted on the inner surface of interior plate 23 and extends generally over finger recess 44. Release lever 50 includes a forwardly protruding actuator tab 51 which extends through actuator window 43 in interior plate 23 and into an interior pocket 47 in the slide portion 100 of latch 5 to selectively shift the same to the unlatched position, as described in greater detail below. An interior lock knob 52 is pivotally received in lock boss 42 on interior plate 23, and is operably connected with the movable key lock member 7 of key lock 6 to lock and unlock latch lock 8 and deadbolt lock 9 as described below.

As best illustrated in FIGS. 4 and 6-8, interior handle 49 is formed integrally with interior plate 23 along a rearwardmost side edge 48 thereof, and includes a central cut away area 53 for finger access to facilitate shifting closure 3 between the open and closed positions. Interior handle 49 has a ramp-shaped construction, which includes a low profile, having a flat portion 54 disposed substantially coplanar with the innermost surfaces of release lever 50 and lock knob 52. Furthermore, interior handle 49 includes an inwardly angled exterior portion 55 in which cut away area 53 is formed, and is disposed in an inwardly angled orientation with respect to flat portion 54. The ramp-shaped exterior portion 55 of interior handle 49 deflects or leads a pleated or sliding screen over the interior of locking paddle handle latch assembly 1, so as to avoid interference. The recess 44 achieves a low profile, while facilitating grasping and rotating interior release lever 50.

In the illustrated example, latch 5 includes a rotary latch mechanism 60, which as best illustrated in FIGS. 1-5, is attached directly to the forwardmost or exterior side edge 61 of housing 2. The illustrated rotary latch 60 has a generally conventional construction, comprising outer and inner housing plates 62 and 63 between which a rotating latch member 64 and a pivoting release arm 65 are pivotally mounted by pins 66 and 67. A pair of coil springs 68 and 69 bias latch member 64 and release arm 65 to the normally unlatched position, as described in greater detail below. A spacer 70 is mounted in housing plate 63 to provide alignment for rotating latch member 64.

Figure 9:
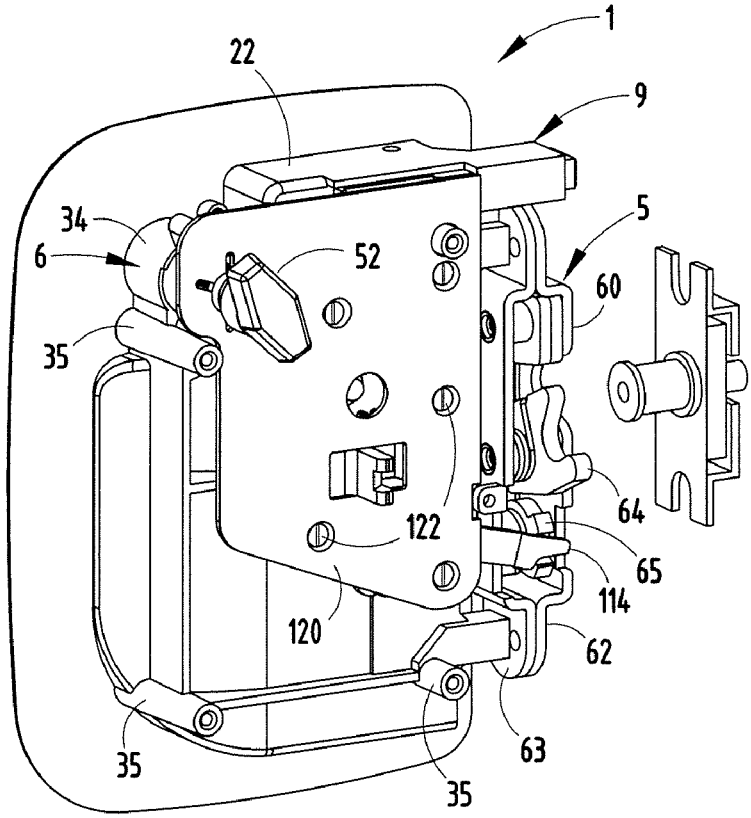
FIG. 9 is a perspective view of a rear portion of the locking paddle handle assembly, shown with the latch in the unlatched position, and an associated strike bolt.
Figure 9A:
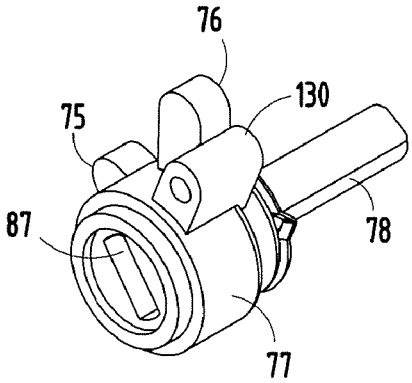
FIG. 9A is an enlarged, perspective view of a lock cam portion of the paddle handle latch assembly, taken from an exterior side thereof.
Figure 9B:
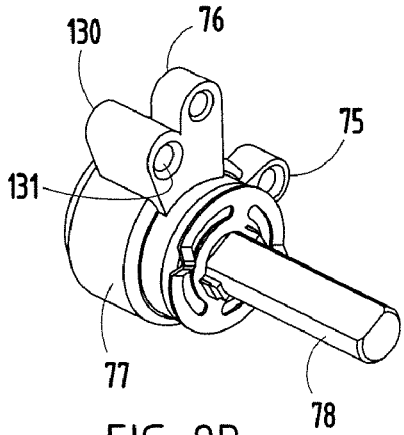
FIG. 9B is an enlarged, perspective view of the lock cam, taken from an interior side thereof.
Figure 10:
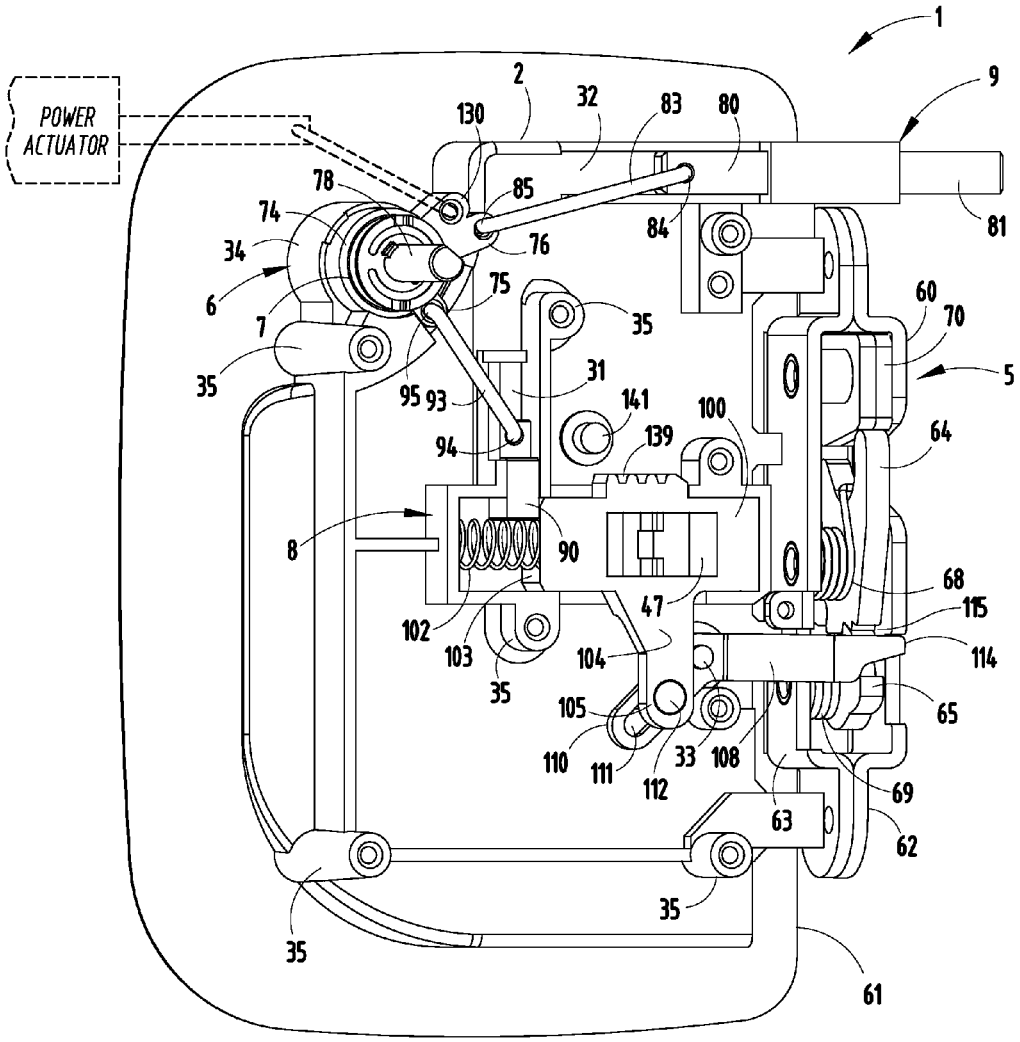
FIG. 10 is an enlarged, perspective view of the interior portion of the locking paddle handle latch assembly, shown with the latch in the latched position, and the latch lock and the deadbolt lock in the locked positions.
Figure 11:
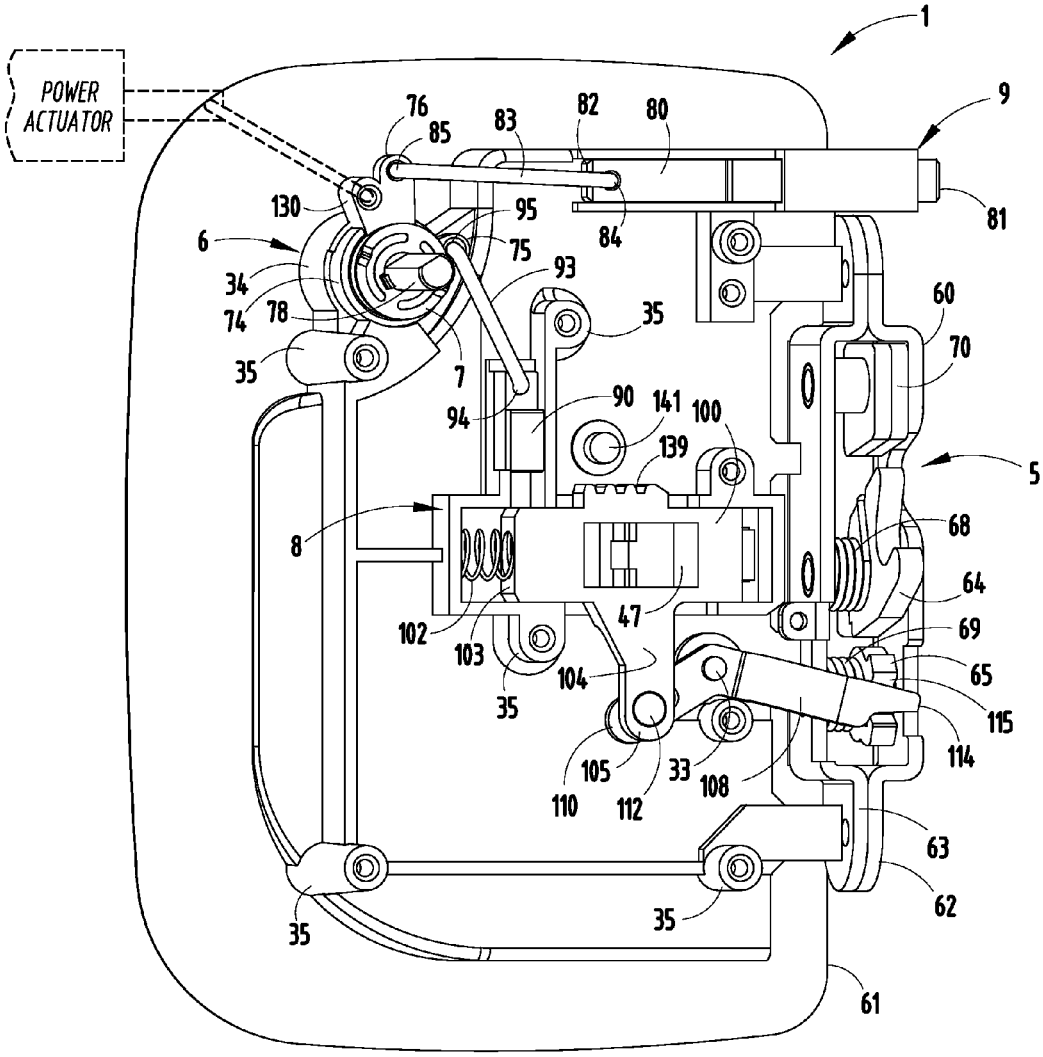
FIG. 11 is an enlarged, perspective view of the interior portion of the locking paddle handle latch assembly, shown with the latch in the unlatched position, and the latch lock and the deadbolt lock in the unlocked positions.

In the illustrated example, the movable key lock member 7 of key lock 6 is in the form of a cylindrical lock plug which is received in the lock aperture 27 on the exterior housing plate 22, and is rotatably mounted in lock boss 34 for rotation between locked and unlocked positions. A multi-arm lock cam 74 is pivotally mounted in the interior end of lock boss 34, and is operably connected with lock plug 7 for rotation therewith: In the illustrated example, lock cam 74 has an interior slot 87 (FIG. 9A) into which a tab 88 (FIG. 4A) on a coupling portion 72 of lock plug 7 is received to transmit rotary motion therebetween. The illustrated lock cam 74 has a first crank arm 75 that is operably connected with latch lock 8 and a second crank arm 76 that is operably connected with deadbolt lock 9. As best illustrated in FIGS. 9A and 9B, multi-arm cam lock 74 has a cylindrically-shaped base 77 with a recessed end oriented toward exterior housing plate 22 and a faced shaft 78 oriented toward interior housing plate 23. The shaft 78 on cam lock 74 extends through the lock boss 42 in the interior housing plate 23, and lock knob 52 is mounted on the interior end thereof, such that rotation of lock knob 52 from the interior of the vehicle rotates cam lock 74 between the locked and unlocked positions, and simultaneously shifts latch lock 8 and deadbolt lock 9 between the locked and unlocked positions.

With reference to FIGS. 4, 4A, 10 and 11, the illustrated deadbolt lock 9 includes a deadbolt 80 slidably mounted in the deadbolt lock slide channel 32 of exterior housing plate 22, and includes an outer end 81 which extends exterior of housing 2 for engagement with doorframe 15, and an inner end 82 which extends interior of housing 2. A first link 83 has a first end 84 thereof pivotally connected with the inner end 82 of deadbolt 80, and a second end 85 thereof pivotally connected with the second crank arm 76 of lock cam 74, such that rotation of lock plug 7 between the locked and unlocked positions longitudinally shifts the deadbolt 80 between the locked and unlocked positions.

As best illustrated in FIGS. 4, 4A; 10 and 11, the illustrated latch lock 8 includes a lock pawl 90 slidably mounted in the latch lock channel slide 31 on the inside surface of the exterior housing plate 22. Lock pawl 90 has an outer end 91 engaging the slide portion 100 of latch 5 in the locked position, and an inner end 92 oriented toward lock cam 74. A second link 93 has a first end 94 connected with the inner end 92 of lock pawl 90, and a second end 95 pivotally connected with the first crank arm 75 of lock cam 74, such that rotation of lock plug 7 between the locked and unlocked positions longitudinally shifts lock pawl 90 between the locked and unlocked positions.

As best illustrated in FIGS. 2-4A, the illustrated latch 5 includes a pocketed slide 100 which is slidably mounted in the latch slide channel 30 on the inside surface of exterior housing plate 22 for laterally shifting between locked and unlocked positions. Slide 100 has an exterior pocket 101 into which the actuator tab 26 on paddle handle 4 is received, such that shifting paddle handle 4 from the exterior of the vehicle between the retracted and extended positions longitudinally shifts slide 100 in a lateral direction between the locked position shown in FIG. 2 and the unlocked position shown in FIG. 3. Slide 100 has an interior pocket 47 into which the actuator tab 51 on release lever 50 is received, such that shifting release lever 50 from the interior of the vehicle similarly shifts slide 100 between the locked and unlocked positions. A coil spring 102 is mounted in the latch slide channel 30 and is abuttingly received in a centering hole in the rearward side edge 103 of slide 100 to urge slide 100 toward the normally locked position shown in FIG. 2. Slide 100 also includes integrally formed actuator arm 104 which extends downwardly from latch slide channel 30 and includes a connector pin aperture 105 adjacent its distal end. A latch actuator arm 108 has a central portion thereof rotatably mounted on pivot pin 33 on the inside surface of exterior housing plate 22. Latch actuator arm 108 has an inner end 110 with a longitudinally extending slot 111 therein through which one end of a connecting pin 112 is slidingly received. The opposite end of connecting pin 112 is mounted in the aperture 105 of actuator arm 104. The outer end 113 of latch actuator arm 108 includes a tapered finger 114 which is disposed a spaced apart distance from the release arm 65 of rotary latch 60 when rotary latch 60 is the latched position shown in FIGS. 2 and 10. The space or gap 115 (FIG. 10) between the finger 114 in latch actuator arm 108 and the release arm 65 of rotary latch 60 ensures that latch 5 is not inadvertently shifted out of the latched position.

In the illustrated locking paddle handle latch assembly 1, an interior backer plate 120 (FIGS. 4, 4A and 9) is disposed between the exterior and interior housing plates 22 and 23, covers the interior faces of deadbolt 80, lock pawl 90 and slide 100, and is attached to fastener bosses 35 on the interior side of exterior housing plate 22 by fasteners 122 to retain the moving components securely in place.

In operation, closure 3 can be shifted from the closed to the open position from the exterior of the vehicle in the following manner. Paddle handle 4 is rotated outwardly from the retracted position to the extended position. Rotation of paddle handle 4 from the retracted position to the extended position pivots actuator tab 26 laterally, which in turn moves slide 100 laterally inwardly in the manner illustrated in FIG. 3. The lateral inward shifting of slide 100 also pivots latch actuator arm 108 in a clockwise direction as illustrated in FIGS. 2 and 3, such that the finger 114 on latch actuator arm 108 abuts the release arm 65 on rotary latch 60, thus causing the rotating latch member 64 to shift to the unlatched position by virtue of the spring biasing force exerted by coil spring 68. The rotating latch member 64 thereby disengages the strike bolt 18, and permits the user to shift closure 3 from the closed position to the open position, as shown in FIG. 1.

Closure 3 can be similarly shifted from the closed position to the open position from the interior of the vehicle in the following manner. With the locking paddle handle assembly in the unlocked position, as shown in FIG. 3, release handle 50 is rotated laterally inwardly from the retracted position to the extended position, which pivots actuator tab 51 laterally, and moves slide 100 inwardly as shown in FIG. 3. The inward shifting of slide 100 also pivots latch actuator arm 108 in a clockwise direction as illustrated in FIGS. 2 and 3, such that the finger 114 on latch actuator arm 108 abuts the release arm 65 on rotary latch 60, thus causing the rotating latch member 64 to shift to the unlatched position by virtue of the spring biasing force exerted by coil spring 68. The rotating latch member 64 thereby disengages the strike bolt 18, and permits the user to shift closure 3 from the closed position to the open position, as shown in FIG. 1.

In order to return the closure 3 to the closed and latched position from either the exterior or interior of the vehicle, the user simply shifts closure 3 to the closed position, which causes the rotating latch member 64 of rotary latch 60 to engage strike bolt 18 and thereby rotate rotary latch member 64 back to the latched position in which it is retained by release arm 65, thereby preventing the door from being inadvertently shifted from the closed position to the open position.

When the closure 3 is in the fully closed and latched position, the same can be positively locked in place by rotation of lock plug 7. More specifically, a matching key 128 is inserted into the key slot 129 in lock plug 7, and the same are then rotated from the unlocked position to the locked position. Rotation of lock plug 7 rotates lock cam 74, which in turn contemporaneously shifts both the deadbolt 80 on deadbolt lock 9 and the lock pawl 90 on latch lock 8 from the unlocked to the locked positions. In the locked position, deadbolt 80 engages the doorframe 15, and positively prevents opening of the door. When lock pawl 90 is in the locked position shown in FIG. 2, it is disposed directly in the path of slide 100, which prevents the same from moving from the latched position. Both the deadbolt lock 9 and the latch lock 8 are be simultaneously unlocked by rotating key 128 and associated lock plug 7 in the opposite direction. The latch lock 8 and deadbolt 9 can be similarly shifted between the locked and unlocked positions from the interior of the vehicle by rotation of interior lock knob 52.

In the illustrated example, the multi-arm lock cam 74 also includes a third crank arm 130, which is adapted for operable connection with a remotely controllable power actuator (not shown), which rotates lock cam 74 and shifts both the latch lock 8 and deadbolt lock 9 between the locked and unlocked positions. More specifically, crank arm 130 (FIGS. 9A and 9B) includes an aperture 131 adjacent its outer end into which an actuator rod or the like (not shown) is received, which is operably connected with a receiver and associated motor (not shown) that are typically mounted in the vehicle door 3. Remote activation of the motor longitudinally shifts the actuator rod, which in turn rotates lock cam 74 between the locked and unlocked positions.

Figure 12:
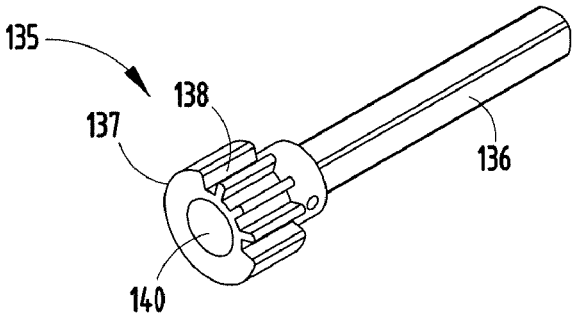
FIG. 12 is a perspective view of an adaptor for interior operation of the locking paddle handle assembly.
Figure 13:
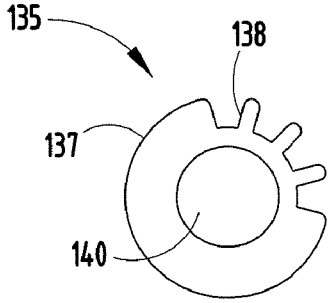
FIG. 13 is a rear view of the remote actuator adaptor.

FIGS. 12 and 13 illustrate an adapter 135 that can be used in conjunction with an alternative interior release actuator (not shown), such as a lever handle, knob or the like, which pivots along a generally horizontal axis. Adapter 135 includes a square shaft 136 with a pinion 137 mounted on the exterior end thereof. Pinion 137 has gear teeth 138 which mate with associated rack teeth 139 (FIGS. 4 and 4A) formed along the upper edge of slide 100, and a central socket 140 (FIGS. 12 and 13) into which a mating pin 141 (FIG. 4A) on exterior housing plate 22 is received to rotatably support adapter 135 thereon. The interior end of shaft 136 projects into the interior of the vehicle, and receives thereon the alternative interior release actuator, such that axial rotation of the same along a generally horizontal axis rotates shaft 136 and pinion 137 to shift slide 100 laterally between the locked and unlocked positions. Actuator cam 108 and pinion 135 can be modified if necessary to provide for a multi-point locking system.

Figure 14:
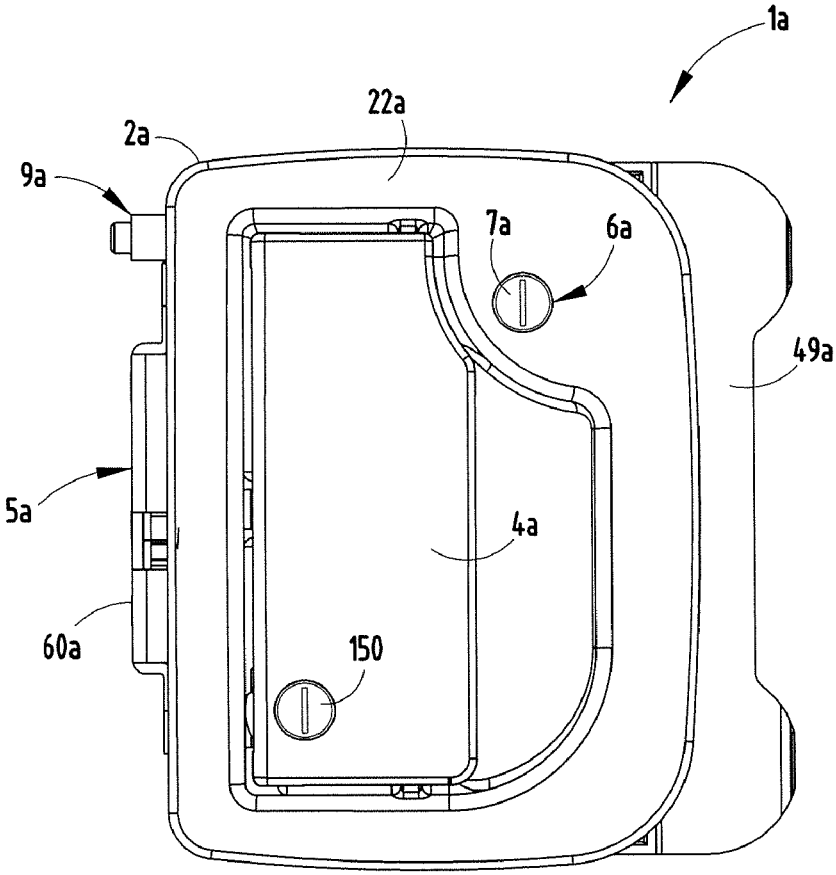
FIG. 14 is a front elevational view of an alternative embodiment of the locking paddle handle latch assembly.

The reference numeral 1*a* (FIG. 14) generally designates another embodiment of the present invention having a separate paddle handle key lock 150. Since locking paddle handle latch assembly 1*a* is similar to the previously described locking paddle handle latch assembly 1, similar parts appearing in FIGS. 1-11 and 14, respectively, are represented by the same, corresponding reference numerals, except for the suffix "a" in the numerals of the latter. In the illustrated example, key lock 150 is mounted in paddle handle 4, and when rotated to the locked position, engages an associated portion of housing 2 to positively prevent paddle handle 4 from being shifted from the retracted position to the extended position. Key lock 6*a* is substantially identical to key lock 6, and serves to lock and unlock the latch lock and deadbolt 9*a* in a fashion similar to that described above. Locking paddle handle latch assembly 1*a* is particularly beneficial for use when the associated vehicle is displayed on a large sales lot or the like, wherein key lock 150 is keyed to accept a master dealer key that can be used to gain interior access to a large number of recreational vehicles for sales purposes.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is as follows:

1. A locking paddle handle latch assembly for closures and the like, comprising:

a housing adapted for mounting adjacent an associated closure of the type that can be shifted between an open position and a closed position;

a paddle handle pivotally mounted in an exterior portion of said housing for rotation between a retracted position and an extended position;

a latch operably connected with said paddle handle, and configured such that when said paddle handle is in said retracted position, said latch is in a latched position, wherein the closure cannot be unintentionally shifted from the closed position, and when said paddle handle is in said extended position, said latch is in an unlatched position, wherein the closure is free to be shifted from the closed position to the open position;

a key lock mounted on said exterior portion of said housing, and including a movable key lock member selectively movable between a locked position and an unlocked position, said movable key lock member comprises a cylindrical lock plug rotatably mounted in said key lock for pivoting between said locked and unlocked positions;

a latch lock movably mounted in said housing, operably connected with said movable key lock member and configured such that when said movable key lock member is in said locked position, said latch lock assumes a locked position in which said latch is retained in said latched position, and when said movable key lock member is in said unlocked position, said latch lock assumes an unlocked position in which said latch is free to be shifted between said latched and unlatched positions;

a deadbolt lock movably mounted in said housing for shifting between a locked position, wherein the closure is positively retained in the closed position, and an unlocked position, wherein the closure is free to be shifted between the open and closed positions; said deadbolt lock being operably connected with said movable key lock member, whereby movement of said movable key lock member between said locked and unlocked positions contemporaneously shifts both said deadbolt lock and said latch lock between said locked and unlocked positions; and a multi-arm lock cam rotatably mounted in said housing and operably connected with said lock plug for rotation therewith; said lock cam having a first crank arm operably connected with said latch lock and a second crank arm operably connected with said deadbolt lock.

2. A locking paddle handle latch assembly as set forth in claim 1, wherein:

said deadbolt lock includes a deadbolt slidably mounted in said housing with an outer end thereof which extends exterior of said housing for engagement with an associated strike, an inner end thereof which extends interior of said housing, and a first link having a first end thereof pivotally connected with said inner end of said deadbolt, and a second end thereof pivotally connected with said second crank arm of said lock cam, such that rotation of said lock plug between said locked and unlocked positions longitudinally shifts said deadbolt between said locked and unlocked positions.

3. A locking paddle handle latch assembly as set forth in claim 2, wherein:

said latch lock includes a lock pawl slidably mounted in said housing with an outer end thereof engaging said latch in said locked position, an inner end oriented toward said lock cam, and a second link having a first end thereof pivotally connected with said inner end of said lock pawl and a second end thereof pivotally connected with said first crank arm of said lock cam, such that rotation of said lock plug between said locked and unlocked positions longitudinally shifts said lock pawl between said locked and unlocked positions.

4. A locking paddle handle latch assembly as set forth in claim 3, wherein:

said closure includes a power actuator; and said lock cam includes a third crank arm configured for operable connection with said power actuator for removably shifting said lock plug between said locked and unlocked positions.

5. A locking paddle handle latch assembly as set forth in claim 4, wherein:

said latch includes a rotary latch mounted on and moving with said housing.

6. A locking paddle handle latch assembly as set forth in claim 5, wherein:

said rotary latch includes a rotating latch member which selectively engages an associated strike, and a pivoting release member which actuates rotation of said rotating latch member.

7. A locking paddle handle latch assembly as set forth in claim 6, wherein:

said latch includes an actuator arm movably mounted in said housing, and having a first portion thereof operably connected with said paddle handle and a second portion thereof selectively engaging said release member.

8. A locking paddle handle latch assembly as set forth in claim 7, wherein:

said actuator arm is positioned a spaced apart distance from said release member in said latched position to avoid inadvertent shifting of said latch to said unlatched position.

9. A locking paddle handle latch assembly as set forth in claim 8, including:

a fixed handle operably connected with an interior portion of said housing and shaped to facilitate manually shifting the closure between the open and closed positions from an interior side of the closure; said fixed handle having a ramp-shaped leading edge to avoid interference with an adjacent sliding closure.

10. A locking paddle handle latch assembly as set forth in claim 9, including:

an interior lock actuator mounted on said interior portion of said housing, and operably connected with said lock cam for rotation therewith, such that shifting said interior lock actuator between locked and unlocked positions shifts both said deadbolt lock and said latch lock between said locked and unlocked positions.

11. A locking paddle handle latch assembly as set forth in claim 10, wherein:

said latch includes a slide movably mounted in said housing for lateral translation between latched and unlatched positions.

12. A locking paddle handle latch assembly as set forth in claim 11, wherein:

said paddle handle includes an inwardly protruding first actuator tab which pivots with said paddle handle; and said slide includes an exterior pocket in which a portion of said first actuator tab is received, such that rotation of said paddle handle between the retracted and extended positions laterally shifts said slide between the latched and unlatched positions.

13. A locking paddle handle latch assembly as set forth in claim 11, including:

a pivotable interior release handle having an outwardly protruding second actuator tab which pivots with said interior release handle; and said slide includes an interior pocket in which a portion of said outwardly protruding second actuator tab is received, such that rotation of said interior release handle between retracted and extended positions laterally shifts said slide between the latched and unlatched positions.

14. A locking paddle handle latch assembly as set forth in claim 13, wherein:

said slide includes a protruding actuator arm rigidly supported thereon; and said latch includes a latch actuator arm having a central portion thereof pivotally mounted on said housing, an interior end thereof slidingly connected with said actuator arm and an exterior end thereof positioned to selectively engage said pivoting release member.

15. A locking paddle handle latch assembly as set forth in claim 14, including:

an adapter having a pinion supported on an interior end thereof; and wherein said slide includes a rack which mates with said pinion on said adapter.

* * * * *